United States Patent [19]

Arai et al.

[11] Patent Number: 4,496,296

[45] Date of Patent: Jan. 29, 1985

[54] DEVICE FOR PRESSING ORBITING SCROLL MEMBER IN SCROLL TYPE FLUID MACHINE

[75] Inventors: Nobukatsu Arai; Shigeru Machida; Eiji Sato, all of Ibaraki; Kenji Tojo; Naoshi Uchikawa, both of Shimizu, all of Japan

[73] Assignee: Hitachi, Ltd., Tokyo, Japan

[21] Appl. No.: 456,486

[22] Filed: Jan. 7, 1983

[30] Foreign Application Priority Data

Jan. 13, 1982 [JP] Japan ..... 57-2699

[51] Int. Cl.[3] ..... F01C 1/02; F01C 19/00; F04B 49/02

[52] U.S. Cl. ..... 418/55; 418/57; 418/94; 417/440

[58] Field of Search ..... 418/55, 57, 94; 417/440

[56] References Cited

U.S. PATENT DOCUMENTS

| | | | |
|---|---|---|---|
| 3,884,599 | 5/1975 | Young et al. | 418/55 |
| 4,383,805 | 5/1983 | Teegarden et al. | 417/440 |
| 4,396,364 | 8/1983 | Tojo et al. | 418/55 |

*Primary Examiner*—John J. Vrablik

*Attorney, Agent, or Firm*—Antonelli, Terry & Wands

[57] ABSTRACT

A scroll type fluid machine having two scroll members each having an end plate and a spiral wrap formed on the end plate, the scroll members being coupled to each other such that the wraps thereof mate with each other. One of two scroll members being adapted to make an orbitary movement with respect to the other scroll member while being prevented from rotating around its own axis, so as to form at least one working chamber of different pressures between two scroll members. At least two pressing force imparting chambers are formed on the opposite side of the orbitary scroll member to the wrap. The pressing force imparting chambers includes a first chamber which is communicated through a communication passage with at least one of the working chambers which is not materially communicating with a low pressure port and is not at all communicating with a high pressure port of the machine, and a second chamber which is communicated with the high pressure port through a communication passage, so that fluid pressures of different levels are applied to the first and second pressing force imparting chambers so as to produce a force which presses the orbitary scroll member to the other scroll member.

26 Claims, 6 Drawing Figures

DEVICE FOR PRESSING ORBITING SCROLL MEMBER IN SCROLL TYPE FLUID MACHINE

BACKGROUND OF THE INVENTION

The present invention relates to a scroll type fluid machine usable as compression means in refrigeration cycle of air conditioner, refrigerator or the like, for compressing air or other gas, or an expander which produces power through expanding a compressive gas and, more particularly, to a device for pressing the orbitary scroll member against cooperating scroll member in the scroll type fluid machine.

In, for example, U.S. Pat. No. 3,884,599, an axial sealing means for attaining a seal between opposing axial end surfaces of two scroll members of a scroll type fluid machine is proposed wherein gas derived from the working chamber, having a pressure of the highest level in the closed loop, is applied to the back surface of the orbitary scroll member opposite to the cooperating scroll member. Usually, the discharge port of the scroll type compressor is connected to a load such as a condenser and the pressure of the gas at the discharge port varies with the change in the operating condition, so that the axial pressing force exterted by the gas on the back surface of the orbitary scroll member fluctuates enough to unstabilize the orbiting movement of the orbitary scroll member, resulting in an unsmooth and unreliable compression. It is to be noted also that, if the suction pressure is changed while the pressure at the discharge port is maintained constant, the separating force tending to separate the two scroll members from each other produced by the gas confined between two scroll members varies so as to cause an unbalance between the force tending to separate two scroll members and the force tending to press the orbiting scroll member, also resulting in an inferior compression.

In U.S. patent application Ser. No. 139,548 a scroll type fluid machine arrangement is proposed which utilizes the gas derived from the working chamber during a compression or expansion to act on the back surface of the orbiting scroll member. The pressure in the working chamber, however, varies in accordance with the change in the suction pressure, so that the axial pressing force acting on the orbiting scroll member is changed conveniently in response to the change in the suction pressure. In this case, therefore, it is possible to maintain stable compression in spite of change in the suction pressure. This stable compression, however, can be obtained only within a limited range of the discharge pressure because, in this case, there is no means to relate the discharge pressure to the internal pressure of the working chamber.

In the equipment having a so-called inlet by-pass type capacity control system, the pressure in the working chamber is reduced to a level below that required for pressing the orbiting scroll member against cooperating scroll member, when the capacity control is actually made. In such a case, it is not possible to effect good seal between the opposing axial end surfaces of two scroll members.

Accordingly, it is a primary object of the invention to provide a device for imparting axial pressing force on the orbiting scroll member of a scroll type fluid machine, improved to ensure an efficient seal between the axial end surfaces of the scroll members.

It is another object of the invention to provide a device for imparting axial pressing force on the orbiting scroll member of a scroll type fluid machine, capable of minimizing the loss of power due to friction.

It is still another object of the invention to provide a device for imparting axial pressing force to the orbitary member of a scroll type fluid machine, which can maintain a suitable axial pressing force even when a capacity control is made by allowing the gas in the closed working chamber to flow directly to the low pressure side by-passing the load.

It is a further object of the invention to provide an improved device for imparting axial pressing force to the orbiting scroll member of a scroll type fluid machine to diminish the deformation of the orbiting scroll member.

It is a still further object of the invention to provide a device for imparting axial pressing force to the orbiting scroll member of a scroll type fluid machine, which can suitably be applied to a compressor having a lubricating system.

It is a still further object of the invention to provide a device for imparting axial pressing force to the orbiting scroll member of a scroll type fluid machine, which can suitably be applied to a compressor of the type in which a compression element and an electric motor for driving the compressor are housed by a common closed container.

It is a still further object of the invention to provide a device for imparting axial pressing force to the orbiting scroll member of a scroll type fluid machine which permits an easy formation of a lubricating oil passage through which a lubricating oil is supplied to the sliding surfaces between two scroll members.

It is a still further object of the invention to provide a device for imparting axial pressing force to the orbiting scroll member of a scroll type fluid machine, which can suitably be applied to a compressor capable of operating in two modes, namely, compression modes as in the case of the cooling and heating operations of a heat pump type air conditioner.

It is a still further object of the invention to provide a device for imparting axial pressing force to the orbiting scroll member of a scroll type fluid machine, suitable for use in a scroll type fluid machine in which the suction pressure and discharge pressure are varied over wide ranges.

To these ends, the present invention provides a device for imparting axial pressing force to the orbiting scroll member of a scroll type fluid machine which is of the type having two scroll members each having a spiral wrap and an end plate, the scroll members being coupled with each other such that their wraps mate with each other, one of the scroll members being adapted to make an orbiting movement relatively to the other without rotating around its own axis, to thereby form at least one working chamber of different pressures between two scroll members. At least two pressing force imparting chambers are formed on the side of the orbiting scroll member opposite to the wrap, with the pressing force imparting chambers including a first chamber which is communicated through a communication passage with at least one of the working chambers which are materially isolated from the low-pressure port and isolated from the high pressure port, and a second chamber which is communicated through a high pressure port through a passage, so that different fluid pressures are applied to the first and second pressing force imparting chambers.

These and other objects, features and advantages of the invention will become clear from the following description of the preferred embodiment taken in conjunction with the accompanying drawings.

DESCRIPTION OF THE PREFERRED EMBODIMENTS

Figure 1:
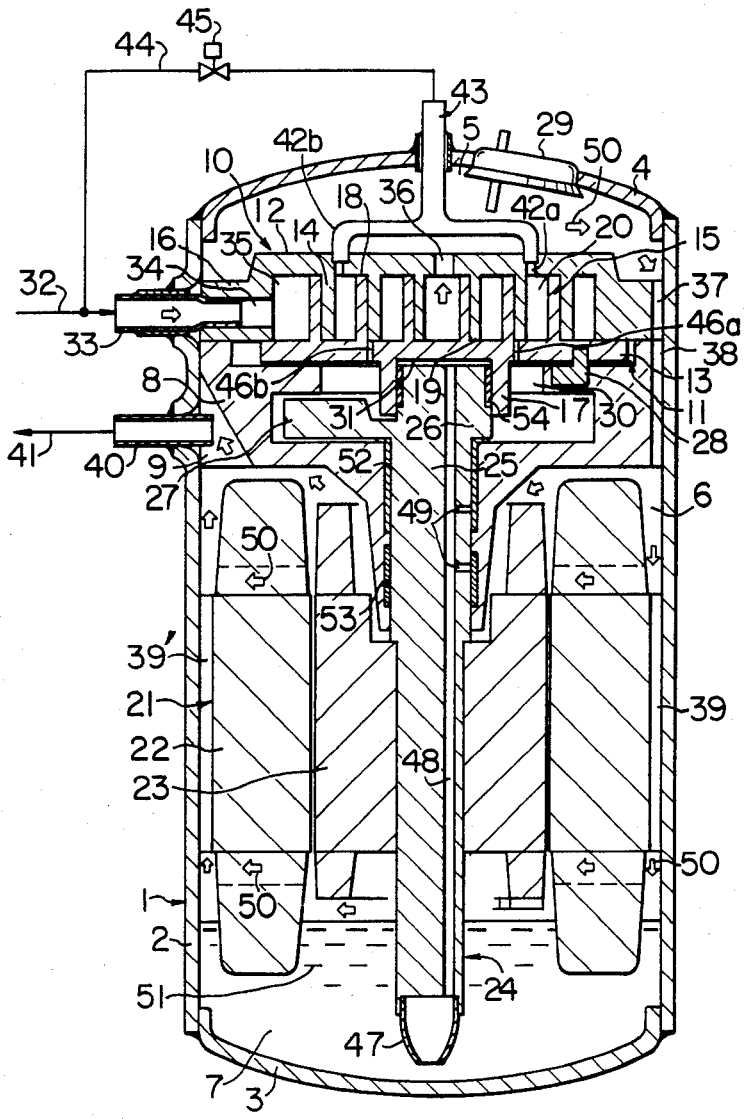
FIG. 1 is a sectional front elevational view of a device in accordance with an embodiment of the invention.

Referring now to the drawings wherein like reference numerals are used throughout the various views to designate like parts and, more particularly, to FIG. 1, a compressor, provided with an inlet by-pass type capacity control function includes a casing generally designated by the reference numeral 1, a frame 8 fixed in the casing 1, a stationary scroll member generally designated by the reference numeral 10 mounted on the frame 8, an orbiting scroll member generally designated by the reference numeral 11 mating with the stationary scroll member 10, a compression chamber 20 defined between wraps of the two scroll members 10, 11, a motor 21 for driving the orbiting scroll member 11, a driving means generally designated by the reference numeral 24, a first back pressure chamber 30 filled with a gas of an intermediate pressure, a second back pressure chamber 31 to which a lubricating oil of a high pressure is introduced, and a capacity control means.

The casing 1 has a hermetic structure composed of a barrel portion 2, an upper cover 3 and a lower cover 4. A compressed gas delivery chamber 5, a compressed gas discharge chamber 6 and a lubricating oil chamber 7 are respectively formed in the upper, middle and lower parts of the casing 1.

The frame 8 is fixed to an upper portion of the barrel 2 of the casing 1. A housing chamber is formed in the upper portion of the frame 8, while a notched part 9 for discharging the compressed gas is formed in one side of the frame 8. A passage port 38 for the compressed gas is formed in one end of the frame 8.

The stationary scroll member 10 is composed of an end plate 12, a wrap 14 and an annular peripheral portion 16, and is fixed at the peripheral portion 16 to the frame 8 through suitable fixing means such as bolts (not shown). The end plate 12 has a delivery port 36 through which the compressed gas is delivered from the central portion of the compression chamber 20, while a suction port 34 for the gas to be compressed is formed in the peripheral portion 16 which defines at its inner side a suction chamber 35. A passage port 37 for the compressed gas, formed in the end of the peripheral portion 16, is communicated with the gas passage port 38.

The orbiting scroll member 11 has an end plate 13 on which formed is a wrap 15. A shaft support portion 17 of the driving means 24 is formed on the back side of the end plate 13 opposite to the wrap 15. The orbiting scroll member 11 is housed by the housing chamber formed in the upper portion of the frame 8. A first back pressure chamber 30 is formed between the end plate 13 and the housing chamber. The end plate 13 is provided with back pressure ports 46*a*, 46*b* through which the pressurized gas is introduced into the first back pressure chamber 30 from a compression chamber 20 in the course of compression. The wrap 15 of the orbiting scroll member 11 has a form substantially identical to that of the wrap 14 of the stationary scroll member 10. More specifically, each wrap has a form which is obtained as a combination of an involute curve and arcs. The stationary scroll member 10 and the orbiting scroll member 11 are coupled together in such a manner that the wraps 14 and 15 thereof mate with each other to define the compression chambers 20 therebetween. The end plate 12 of the stationary scroll member 10 and the axial end surface of the wrap 15 of the orbiting scroll member 11 makes a slight pressure contact with each other at the contact surface 18. Similarly, the end plate 13 of the orbiting scroll member 11 and the end surface of the wrap 14 of the stationary scroll member 10 makes a slight pressure contact at the contacting surface 19.

The motor 21 has a stator 22 and a rotor 23, and is positioned in the casing 1 substantially at the heightwise mid portion of the latter. The stator 22 is provided with a plurality of circumferentially spaced gas passage ports 39, 39'.

Figure 2:
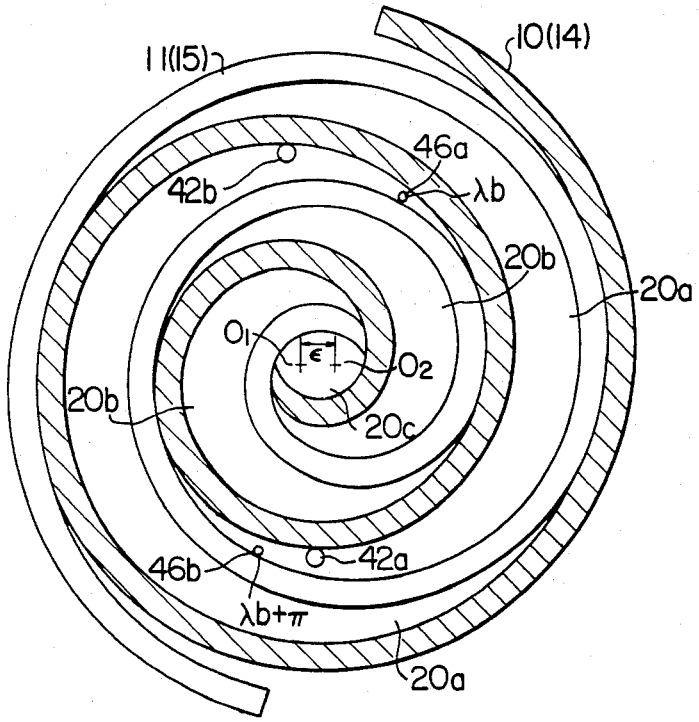
FIG. 2 is an enlarged horizontal sectional view of the device shown in FIG. 1 taken to include the portion where the wraps of two scroll members mate with each other.

The driving means 24 has a main shaft 25 which is coupled to the rotor 23 of the motor 21 and rotatably supported by the frame 8 through a pair of slide bearings 52 and 53, an eccentric shaft 26 connected to the upper end of the main shaft 25 and the shaft supporting portion 17 engaging with the eccentric shaft 26. As shown in FIG. 2, the axis $O_2$ of the eccentric shaft 26 is offset from the axis $O_1$ of the main shaft 25 by a distance $\epsilon$. The eccentric shaft 26 is engaged by the shaft supporting portion 17 through a slide bearing 54 which also serves as a seal, so that the orbiting scroll member 11 makes an orbiting movement around the center of the stationary scroll member 10. The slide bearing 53 has a sealing function. An oil pumping piece 47 is attached to the lower end of the main shaft 25. An oil supplying passage 48 and two oil supplying ports 49 are formed over the main shaft 25 and the eccentric shaft 26. The end plate 13 of the orbiting scroll member 11 is provided with an oil supplying port (not shown), through which a lubricating oil 51 is supplied to sliding portions requiring lubrication. A second back pressure chamber 31 is formed between the upper end of the eccentric shaft 26 and the shaft supporting portion 17 of the orbitary scroll member 11.

Referring back to FIG. 1, a balance weight 27 is provided on the main shaft, with rotation prevention members 28 being provided between the orbiting scroll member 11 and the frame 8. A hermetic terminal 29 is provided on the end cover 4.

The gas to be compressed is drawn into the compression chamber 20 through a suction pipe 33 secured to an upper portion of the barrel 2 of the casing 1, a suction port 34 formed in the peripheral portion 16 of the stationary scroll member 10 and a suction chamber 35. The gas 50 compressed in the compression chamber 20 is discharged into the discharge chamber 6 in the casing 1, through a delivery port 36 formed in the central portion of the end plate 12 of the stationary scroll member 10, a discharge chamber 5 formed in the upper portion of the casing 1, a gas passage port 37 formed in the peripheral portion 16 of the stationary scroll member 10, and a gas passage port 38 formed in the frame 8. A part of the compressed gas 50 is introduced from the discharge chamber 6 into the notched part 9 formed in the frame 8, while the remaining part of the compressed gas 50 is introduced into the lubricating oil chamber 7 in the casing 1 through a gas passage port 39 formed in the stator 22 of the motor 21 and is further introduced into the notched part 9 formed in the frame 8 via another gas passage port 39' formed in the stator 22. This part of the gas is further discharged to the outside of the compressor through a discharge pipe 40 connected to the barrel 2 of the casing 1 and then through a discharge pipe 41 leading to the outside of the compressor.

The capacity control means for the compression chamber 20 includes by-pass ports **42*a*, 42*b* for the sucked gas provided in the end plate 12 of the stationary scroll member 10, a branched by-pass pipe 43 connected to the by-pass ports 42*a*, 42*b*, a by-pass pipe 44 through which the by-pass pipe 43 is connected to a suction pipe 32, and a solenoid valve 45 disposed at an intermediate portion of the by-pass pipe 44. The solenoid valve 45 is adapted to be maintained in an open position when the compressor is under a capacity control. When the solenoid valve 45 is opened, the sucked gas is allowed to directly flow back to the suction pipe 32 from an intermediate portion of the compression chamber 20, through the by-pass ports 42*a*, 42*b*, by-pass pipe 43, solenoid valve 45 and the by-pass pipe 44 to thereby effect a control of the volume of the gas finally confined in the compression chamber. The solenoid valve 45**, therefore, is closed during the rating operation of the compressor.

The means for imparting the minimum required external force for keeping a seal between the contact surfaces of the end plates and wrap end surfaces of two scroll members 10 and 11, i.e. the means for imparting suitable axial pressing force, includes two systems. One of the systems is constructed to introduce the gas from the compression chamber 20 in the course of compression into the first back pressure chamber 30 formed between the end plate 13 and the housing chamber of the frame 8 through the back pressure ports **46*a*, 46*b* formed in the end plate 13 of the scroll member 11. The other of the two systems is constructed to introduce the pressure of the compressed gas from the central portion of the compression chamber 20 into the discharge chamber 6 formed in the intermediate portion of the casing 1 and the lubricating oil chamber 7 under the discharge chamber 6, through the discharge port 36 formed in the end plate 12 of the stationary scroll member 10, discharge chamber 5 formed in the upper part of the casing 1, the gas passage port 37 formed in the peripheral portion 16 of the stationary scroll member 10, the gas passage port 38 formed in the frame 8 and then through the gas passage port 39 formed in the stator 22 of the motor 21. The discharge pressure thus introduced pressurizes the lubricating oil 51 so that the lubricating oil of the pressure corresponding to the discharge pressure of the gas is introduced through the lubricating oil passage 48 in the drive shaft 24 into the second back pressure chamber 31 formed between the upper end of the eccentric shaft 26 and the shaft supporting portion 17 of the orbiting scroll member 11**.

Figure 4:
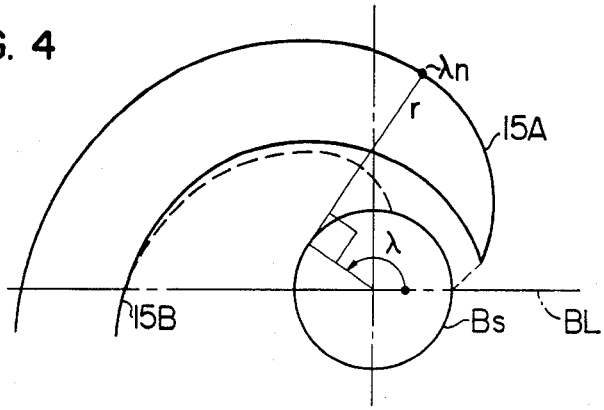
FIG. 4 is an illustration showing how the wrapping angle of the wrap is expressed.

FIG. 4 illustrates the manner in which the wrapping angle may be employed for identifying the positions of the back pressure ports **46*a*, 46*b*. Assuming that the wrap 15 is formed of an involute curve consisting of an inner curve 15B and an outer curve 15A, the wrapping angle $\lambda$ is given as the angle of rotation of the involute curve on the base circle Bs. The point $\lambda n$ on the outer curve 15A** is a point appointed by the wrapping angle $\lambda$. A symbol BL represents a base axis line.

The intermediate pressure Pb required for imparting a suitable axial pressing force to the orbiting scroll member 11 varies in dependence upon various factors such as, for example, operating condition of the compressor, size and form of the wraps, area of the upper end surface of the eccentric portion 26 of the drive shaft 24, and so forth. The positions of the back pressure ports **46*a*, 46*b*** for obtaining necessary intermediate pressure for imparting suitable axial pressing force are determined as follows.

The pressure Pb derived through the back pressure ports **46*a* and 46*b*** is calculated in accordance with the following formula (1).

$$Pb = \left| \frac{1}{2\pi} \int_{\lambda b+2\pi}^{\lambda b} P(\lambda)d\lambda \right| \quad (1)$$

On the other hand, the back pressure necessary for attaining the suitable axial pressing force is given by the following formula (2).

$$Pb \cdot Ab + Pd \cdot Ad = Fpa + (Ms/Rb) + Fs \quad (2)$$

where:

Pb: suitable intermediate pressure (pressure in first back pressure chamber)

Ab: Area of the back surface of the orbiting scroll member to which the pressure Pb is applied Pd: high pressure of gas or lubricating oil (pressure in the second back pressure chamber)

Ad: Area to which the pressure Pd is applied

Fpa: axial fluid force within wraps

Ms: Moment imparted to orbiting scroll by the radial fluid force within wraps.

Rb: Radius of end plate of orbiting scroll

Fs: Force applied to sliding surfaces of end plates caused by hydraulic pressure.

The position $\lambda b$ of the back pressure port **46*a* and the position $\lambda b+\pi$ of the back pressure port 46*b* are determined by first calculating the level of the pressure Pb in accordance with the formula (2) and then calculating the wrapping angle $\lambda b$ satisfying the thus obtained pressure Pb in accordance with the formula (1). The positions of the back pressure ports 46*a*, 46*b* are thus determined are not always the positions that communicate only with the perfectly closed working chamber formed by the wraps 14 and 15 but, in some cases, the back pressure ports 46*a*, 46*b* are allowed to communicate for a certain period of time with a working chamber 20*a*** opening to the suction chamber.

The back pressure port **46*a* is formed at a position along the outer curve of the wrap 15 while the back pressure port 46*b* is formed at a position along the inner curve of the wrap 15. The ports 46*a*, 46*b* are usually but not essentially circular, because the circular form is easy to obtain by machining. For an easier finishing, the back pressure ports 46*a*, 46*b* are so formed that their brim coincide with the inner curve and outer curve of each wrap 15 or spaced slightly therefrom, although the ports 46***a*, 46*b* may be formed to cut into the wrap 15 or in the side surface of the wrap 15.

The size of the back pressure ports 46*a*, 46*b*, i.e. the diameter of the ports when the later are circular, should be smaller than the thickness t of the wrap 14 at the greatest, because, when these ports are formed in the end plate 13, they must be sealed by the end surfaces of the wrap 14. According to an ordinary design, the thickness t of the wrap 14 is equal to the thickness of the wrap 15. The lower limit of the diameter of the port is approximately $(\epsilon+t)/10$, although it varies depending on the rate of gas treated by the machine per unit time, the volume of the first back pressure chamber 30 and other factors.

Figure 5:
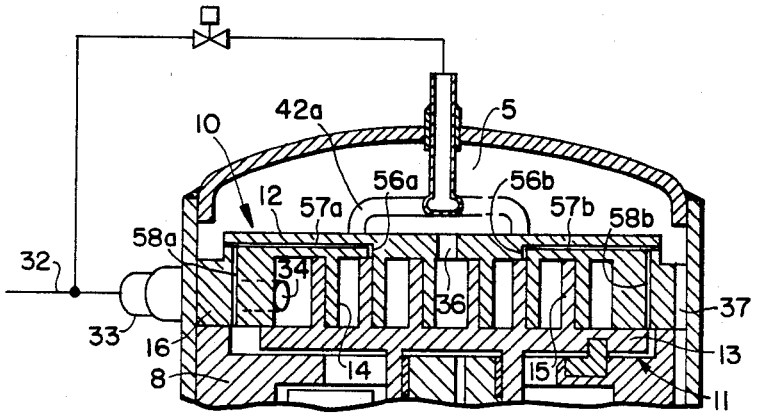
FIG. 5 is a partial cross-sectional front elevational view of another embodiment constructed in accordance with the present invention.

In the first embodiment shown in FIG. 1, the back pressure ports 46*a*, 46*b* are formed in the end plate 13 of the orbiting scroll member 11. However, this is not exclusive and, for example, as shown in FIG. 5, back pressure ports 56*a*, 56*b* may be formed in the end plate 12 of the stationary scroll member 10 at such a position so as to permit extraction of gas of a similar intermediate pressure. In such a case, the back pressure ports 56*a*, 56*b* are respectively connected to the back pressure chamber 30 through separate pipes 57*a*, 57*b*, 58*a*, 58*b*.

If the introduction of the lubricating oil into the second back pressure chamber is not necessary, it is possible to form a small port in the central portion of the end plate 13 of the orbiting scroll member 11 defining the working chamber 20*c* so as to communicate with the second back pressure chamber 31 so that the gas of high pressure is introduced directly into the second back pressure chamber 31. In this case, the second back pressure chamber 31 is isolated from the lubricating oil passage 48.

The scroll type compressor of the described above operates in the following manner.

For the rated operation, i.e. full-load operation, of the compressor, the solenoid valve 45 is closed and the motor 21 is started so that the drive shaft 24 starts to rotate thereby to cause an orbiting motion of the orbiting scroll member 11 with a radius of orbiting movement coinciding with the distance $\epsilon$ between the main shaft 25 of the drive shaft 24 and the eccentric shaft 26.

As a result of the orbiting movement of the orbiting scroll member 11, the gas is sucked into the compression chamber 20 through the suction pipe 32, suction pipe 33, suction port 34 and the suction chamber 35, and is progressively compressed as it is moved from the outer peripheral portion 20*a* of the compression chamber 20 towards the central portion 20*c* through the intermediate portion 20*b*.

As shown by the arrows in FIG. 1, the compression gas 50, compressed in the compression chamber 20, is discharged to the discharge chamber 5 formed in the upper portion of the casing 1 through the discharge port 36 which is provided in the central portion of the stationary scroll member 10. Then, the gas is discharged to the discharge chamber 6 in the casing 1, through the gas passage port 37 formed in the peripheral portion 16 of the stationary scroll member 10 and a gas passage port 38 formed in the frame 8. A part of this gas 50 is introduced into the notched part 9 formed in the frame 8 through an upper portion of the motor 21, while the other part flows into the lubricating oil chamber 7 in the casing 1 through the gas passage port 39 formed in the stator 22 of the motor 21 and further into the notched part 9 in the frame 8 through the other gas passage port 39' provided in the stator 22. While flowing in the manner described above, the compressed gas 50 effectively cools the motor 21 and is taken out of the compressor through the notched part 9, discharge pipe 40 and the discharge pipe 41.

During the compression of the gas, a force produced by the compressed gas acts on the orbiting scroll member 11 to move the same away from the stationary scroll member 10. On the other hand, the gas of the intermediate pressure, which is introduced through the back pressure ports 46*a*, 46*b* in the end plate 13 of the orbiting scroll member 11 into the first back pressure chamber 30 between the end plate 13 of the orbiting scroll member 11 and the housing chamber in the frame 8, produces a force which acts on the back surface of the orbiting scroll member 11 to press towards the stationary scroll member 10 against the aforementioned force which tends to move the orbiting scroll member 11 away from the stationary scroll member 10. At the same time, the compressed gas introduced into the lubricating oil chamber 7 pressurizes the lubricating oil 51 so that the lubricating oil of the pressure corresponding to the delivery pressure of the compressor is introduced into the second back pressure chamber 31 formed between the shaft supporting portion 17 of the orbiting scroll member 11 and the upper end of the eccentric shaft 26. The pressure of the thus introduced lubricating oil produces a force which also acts on the back surface of the orbiting scroll member against the aforementioned force which tends to move the orbiting scroll member 11 away from the stationary scroll member 10. It will be seen that the axial pressing force acting on the back surface of the orbiting scroll member, applied through two systems explained above, makes it possible to maintain a stable and safe seal on the contact surface 18 between the end plate 12 of the stationary scroll member 10 and the end surface of the wrap 15 of the orbiting scroll member 11, as well as on the contact surface 19 between the end plate 13 of the orbiting scroll member 11 and the end surface of the wrap 14 of the stationary scroll member 10.

Consequently, for effecting a capacity control to reduce the capacity of the compression chamber 20, the solenoid valve 45 constituting the capacity control means is opened, and in the region of the compression chamber 20 in which the by-pass ports 42*a*, 42*b* open, the gas is allowed to directly flow into the suction pipe 32 through the by-pass ports 42*a*, 42*b*, by-pass pipe 43, solenoid valve 45 and the by-pass pipe 44. As a result, the effective compression is made only after the by-pass holes 42*a*, 42*b* are closed by the end of the wrap 15 of the orbiting scroll member 11, so that the capacity of the compressor is reduced.

When the compressor operates with reduced capacity, the electric power supplied to the motor 21 is also reduced and, therefore, it is possible to effect two-staged capacity control by a single compressor without changing the speed of the motor 21.

During the operation with reduced capacity, the by-pass ports 42*a* and 42*b* take positions near the back pressure ports 46*a* and 46*b* and the by-pass ports are allowed to communicate with the outer peripheral portion 20*a* of the compression chamber 20 for longer period of time. Consequently, the pressure introduced into the first back pressure chamber 30 from the compresion chamber 20 through the back pressure ports 46*a*, 46*b* is reduced to a level approximating the suction pressure.

However, the lubricating oil 51 is pressurized also in this case by the compressed gas 50 introduced into the lubricating oil chamber 7, so that the oil pressure corresponding to the delivery pressure of the gas 50 is introduced through the oil supplying passage 48 in the drive shaft 24 into the second back pressure chamber 31 to produce a force of a level suitable to overcome the separating force acting between the orbiting scroll member 11 and the stationary scroll member 10. It is, therefore, possible to maintain the stable and reliable seal on the contact surface 18 between the end plate 12 of the stationary scroll member 10 and the end surface of the wrap 15 on the orbiting scroll member 11, as well as on the contact surface 19 between the end plate 13 of the orbiting scroll member 11 and the end surface of the wrap 14 of the stationary scroll member 10.

In the described embodiment, it is possible to omit specific piping arrangement and specific control means for the adjustment of the back pressure, because both of the gas passage ports 37, 38 and 39, 39' are formed in the members which are mounted in the casing 1.

During the rating operation of the compressor, a suction pressure $P_1$ is applied on the side of the end plate 13 of the orbiting scroll member 11. Pressures in operating chambers $P_2$, $P_3$, $P_4$ progressively increases towards the center of the end plate 13 and a pressure $P_5$, slightly higher than the suction pressure $P_1$, acts on the end of the end plate 13. On the other hand, the back side of the end plate 13, opposite to the compression chamber 20, receives the intermediate pressure Pb of the gas under compression transmitted into the first back pressure chamber 30 through the back pressure ports 46*a*, 46*b*, as well as oil pressure $P_4'$ acting in the second back pressure chamber 31 and corresponding to the gas delivery pressure transmitted through the oil supply passage 48 provided in the drive shaft. The pressures Pb and $P_4'$ in combination produce a force which act against the separating force produced by the pressures $P_1$ to $P_5$ which tends to separate the orbiting scroll member 11 from the stationary scroll member 10.

Figure 3A:
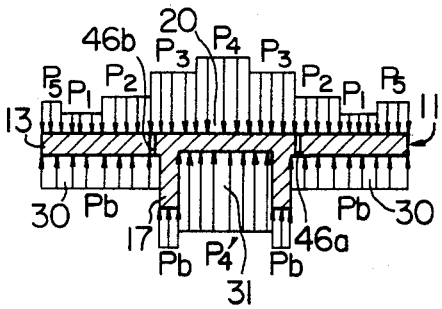
FIGS. 3(A) and 3(B) are the charts showing the pressure distribution on the scroll side and back side of the end plate of an orbiting scroll member as observed when the fluid machine is operating at the rating capacity and when the machine is under the capacity control, respectively.
Figure 3B:
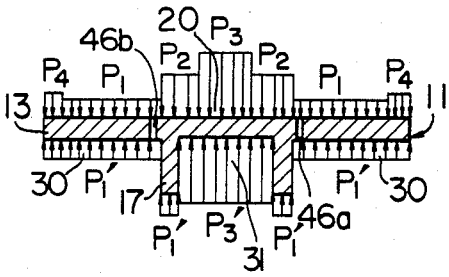

When the compressor operates with reduced capacity as a result of the capacity control, the pressures $P_1$ to $P_4$ act on the side of end plate 13 facing the compression chamber 20 in the manner shown in FIG. 3B.

On the other hand, a pressure $P_1'$ substantially equal to the suction pressure $P_1$ acts in the first back pressure chamber 30 on the back side of the end plate 13, through the back pressure ports 46*a* and 46*b* and, in addition, oil pressure $P_3'$ corresponding to the delivery pressure acts in the second back pressure chamber 31 through the oil supplying passage. It is, therefore, possible to apply at least the minimum axial pressing force by the pressures $P_1'$ and $P_3'$ on the back side of the end plate 13, to overcome the separating force produced by the pressures $P_1$ to $P_4$ and acting on the side of the end plate 13 tending to separate the orbiting scroll member 11 from the stationary scroll member 10.

Although the device described hereinabove is applied to a compressor having a capacity control function, it will be clear to those skilled in the art that the device of the invention can equally be applied to a compressor having no capacity control function. In such a case, the compressor is devoid of the by-pass ports 42*a*, 42*b* formed in the end plate of the stationary scroll member 10, the by-pass pipes 43, 44 and the solenoid valve 45 which are shown in FIGS. 1 and 2. In such an application, the compressor operates in same manner as the described hereinabove except for the described capacity control operation.

Although the invention has been described through specific terms, it is to be noted here that the described embodiment is not exclusive and various changes and modifications may be effected without departing from the scope of the invention which is limited solely by the appended claims.

What is claimed is:

1. A scroll type fluid machine comprising:

a stationary scroll member having an end plate and a spiral wrap formed on one side of said stationary scroll member so as to protrude upright therefrom;

an orbiting scroll member having an end plate and a spiral wrap formed on one side of said end plate so as to protrude upright therefrom, and adapted to be coupled with said stationary scroll member such that said wraps on both scroll members mate with each other to define a plurality of working chambers therebetween;

a frame means fixed to said stationary scroll member;

a driving means for causing an orbiting movement of said orbiting scroll member, said driving means including a main shaft rotatably carried by said frame means through bearings, an eccentric shaft adapted to transmit the movement of said main shaft to said orbiting scroll member at a position spaced by a distance substantially equal to a radius of relative orbiting movement between said scroll members;

a high pressure port means;

a low pressure port means;

a rotation prevention means disposed between said orbiting scroll member and a stationary part of said machine so as to maintain a fixed angular relationship of said orbiting scroll member to said stationary scroll member;

a first back pressure chamber defined by a cooperation of said frame means, said drive shaft and said orbiting scroll member, said first back pressure chamber being adapted to hold a fluid pressure which imparts an axial pressing force to said orbiting scroll member;

a first back pressure passage means providing a communication between said first back pressure chamber and at least one of said working chambers which holds an intermediate pressure of the fluid and does not substantially communicate with said low pressure port means and never communicates with said high pressure port means;

a second back pressure chamber defined by said eccentric shaft of said driving means and by a shaft supporting portion rotatably and axially movably engaging with said eccentric shaft, said second back pressure chamber being adapted to hold a fluid pressure for imparting an axial pressing force to said orbiting scroll member;

a second back pressure passage means including a fluid passage formed in said driving means and adapted to introduce the fluid pressure into said second back pressure chamber so as to impart an axial pressing force to said orbiting scroll member; and wherein the first back pressure chamber and the second back pressure chamber have a volume such that a total axial pressing force applied therefrom to the orbiting scroll member is in accordance with the following relationship:

$$Pb \cdot Ab + Pd \cdot Ad = Fpa + (Ms/Rb) + Fs$$

where:

Pb = a suitable intermediate pressure in the first back pressure chamber,

Ab = an area of the back surface of the orbiting scroll member to which the pressure Pb is applied, Pd = a high pressure of gas or lubricating oil in the second back pressure chamber, Ad = an area to which the pressure Pd is applied, Fpa = an axial fluid force within the working chambers, Ms = moment imparted to the orbiting scroll member by the radial fluid force within the working chambers, Rb = radius of the end plate of the orbiting scroll member, and Fs = force applied to the sliding surfaces of the end plates caused by hydraulic pressure.

2. A scroll type fluid machine according to claim 1, wherein said first back pressure passage means includes two back pressure ports formed in said orbiting scroll member, while said second back pressure passage means includes an upper housing chamber communicating with said high pressure port, an intermediate housing chamber, a lower housing chamber serving also as an oil pan, and a passage providing a communication between said upper housing chamber and said lower housing chamber.

3. A scroll type fluid machine according to claim 1, wherein said shaft supporting portion of said driving means is formed on the back side of said orbiting scroll member, while said eccentric shaft of said driving means is formed on said main shaft, said eccentric shaft having an axis which is spaced from the axis of said main shaft by a distance substantially equal to the radius of orbiting movement of said orbiting scroll member.

4. A scroll type fluid machine according to claim 2, wherein said back pressure ports are formed in said end plate of said orbiting scroll member and have a diameter which is smaller than a thickness of the wrap of said scroll member at the greatest.

5. A scroll type fluid machine according to claim 4, wherein said back pressure ports are formed in said end plate of said orbiting scroll member and have a diameter smaller than the thickness of wrap of said scroll member at the greatest.

6. A scroll type fluid machine according to claim 2, wherein the fluid supplied to said second back pressure chamber is an oil of a pressure level substantially equal to the pressure of the fluid at said high pressure port means.

7. A scroll type fluid machine according to claim 3, wherein the machine serves as a compressor and the fluid supplied to said second back pressure chamber is a lubricating oil of a pressure level substantially equal to a pressure of said fluid at said high pressure port means.

8. A scroll type fluid machine according to claim 2, further comprising a slide bearing having a sealing function interposed between said shaft supporting portion and said eccentric shaft, said slide bearing being adapted to hold the fluid pressure in said second back pressure chamber.

9. A scroll type fluid machine according to claim 3, further comprising a motor for driving said main shaft of said driving means, and a housing means surrounding said motor, stationary scroll member, orbiting scroll member and said frame means, and wherein an internal space of said housing means being communicated with said high pressure port means.

10. A scroll type fluid machine according to claim 9, wherein said housing means includes an upper chamber disposed above said stationary scroll member and communicating with said high pressure port means, an intermediate chamber accomodating said stationary scroll member, frame means and said motor, and a lower chamber accommodating a lubricating oil.

11. A scroll type fluid machine according to claim 9, wherein the second back pressure passage means for supplying the lubricating oil to said second back pressure chamber is formed in said main shaft and said eccentric shaft, the lower end opening of the fluid supply passage formed in said main shaft is positioned in the lubricating oil accommodated in said housing means.

12. A scroll type fluid machine comprising:

a stationary scroll member having an end plate and a spiral wrap formed on one side of said stationary scroll member to protrude upright therefrom;

an orbiting scroll member having an end plate and a spiral wrap formed on one side of said end plate to protrude upright therefrom, and adapted to be coupled with said stationary scroll member such that said wraps on both scroll members mate with each other to define a plurality of compression chambers therebetween;

a frame means fixed to said stationary scroll member;

a driving means for causing an orbiting movement of said orbiting scroll member and having a main shaft rotatably carried by said frame means through bearings, an eccentric shaft adapted to transmit the movement of said main shaft to said orbiting scroll member at a position spaced by a distance substantially equal to the radius of relative orbiting movement between said scroll members;

a high pressure port means;

a low pressure port means;

a rotation prevention means disposed between said orbiting scroll member and said frame means so as to prevent said orbiting scroll member from rotating around the axis of said eccentric shaft;

a passage means providing a communication between a chamber under compression and the suction side of said machine;

a stop valve means disposed at an intermediate portion of said passage means;

a first back pressure chamber defined by a cooperation of said frame means, said drive shaft and said orbiting scroll member, said first back pressure chamber being adapted to hold a fluid pressure which imparts an axial pressing force to said orbiting scroll member;

a first back pressure passage means providing a communication between said first back pressure chamber and at least one of said compression chambers which holds an intermediate pressure of the fluid and does not substantially communicate with said low pressure port means and never communicates with said high pressure port means;

a second back pressure chamber defined by said eccentric shaft of said driving means and by a shaft supporting portion rotatably and axially movably engaging with said eccentric shaft, said second back pressure chamber being adapted to hold a fluid pressure for imparting an axial pressing force to said orbitary scroll member;

a second back pressure passage means including a fluid passage formed in said driving means and adapted to introduce the fluid pressure into said second back pressure chamber so as to impart an axial pressing force to said orbitary scroll member.

13. A scroll type fluid machine according to claim 12, wherein said first back pressure passage means includes two back pressure ports formed in said orbiting scroll member, while said second back pressure passage means includes an upper housing chamber communicating with said high pressure port means, an intermediate housing chamber, a lower housing chamber serving as an oil pan, and a passage providing a communication between said upper housing chamber and said lower housing chamber.

14. A scroll type fluid machine according to claim 12, wherein said shaft supporting portion of said driving means is formed on the back side of said orbiting scroll member, while said eccentric shaft of said driving means is formed on said main shaft, said eccentric shaft having an axis which is spaced from the axis of said main shaft by a distance substantially equal to the radius of orbiting movement of said orbiting scroll member.

15. A scroll type fluid machine according to claim 13, wherein said back pressure ports are formed in said end plate of said orbiting scroll member and have a diameter which is smaller than the thickness of the wrap of said scroll member at the greatest.

16. A scroll type fluid machine according to claim 15, wherein said back pressure ports are formed in said end plate of said orbiting scroll member and have a diameter smaller than the thickness of wrap of said scroll members at the greatest.

17. A scroll type fluid machine according to claim 13, wherein the fluid supplied to said second back pressure chamber is an oil of a pressure level substantially equal to the pressure of the fluid at said high pressure port.

18. A scroll type fluid machine according to claim 13, wherein the machine serves as a compressor and the fluid supplied to said second back pressure chamber is a lubricating oil of a pressure level substantially equal to the pressure of said fluid at said high pressure port.

19. A scroll type fluid machine according to claim 13, further comprising a slide bearing having a sealing function interposed between said shaft supporting portion and said eccentric shaft, said slide bearing being adapted to hold the fluid pressure in said second back pressure chamber.

20. A scroll type fluid machine according to claim 14, further comprising a motor for driving said main shaft of said driving means, and a housing means surrounding said motor, stationary scroll member, orbiting scroll member and said frame means, the internal space of said housing means being communicated with said high pressure port means.

21. A scroll type fluid machine according to claim 20, wherein said housing means includes an upper chamber disposed above said stationary scroll member and communicating with said high pressure port, an intermediate chamber accomodating said stationary scroll member, frame means and said motor, and a lower chamber accomodating a lubricating oil.

22. A scroll type fluid machine according to claim 20, wherein the second back pressure passage means for supplying the lubricating oil to said second back pressure chamber is formed in said main shaft and said eccentric shaft, the lower end opening of the fluid supply passage formed in said main shaft being positioned in said lubricating oil accommodated in said housing means.

23. A scroll type fluid machine according to claim 1, wherein the pressure Pb in the first back pressure chamber is determined in accordance with the following relationship:

$$Pb = \left| \frac{1}{2\pi} \int_{\lambda b+2\pi}^{\lambda b} P(\lambda)d\lambda \right|,$$

where:

$\lambda$=a wrapping angle of the wraps in radians, $\lambda b, \lambda b+2\pi$=the position of ports in the orbiting scroll member by which the first back pressure passage means communicates with at least one of the working chambers, and P=a pressure in the working chamber.

24. A scroll type fluid machine according to claim 12, wherein the passage means providing a communication between the compression chamber under compression and the suction side of the machine includes circular bypass ports formed in the end plate of the stationary scroll member, and wherein each diameter of the bypass ports is smaller than a thickness of the wrap of the orbiting scroll member.

25. A scroll type fluid machine according to claim 12, wherein the first back pressure chamber and the second back pressure chamber have a volume such that a total axial pressing force applied therefrom to the orbiting scroll member is in accordance with the following relationship:

$$Pb \cdot Ab + Pd \cdot Ad = Fpa + (Ms/Rb) + Fs$$

Pb=a suitable intermediate pressure in the first back pressure chamber,

Ab=an area of the back surface of the orbiting scroll member to which the pressure Pb is applied, Pd=a high pressure of gas or lubricating oil in the second back pressure chamber, Ad=an area to which the pressure Pd is applied, Fpa=an axial fluid force within the working chambers, Ms=moment imparted to the orbiting scroll member by the radial fluid force within the working chambers, Rb=radius of the end plate of the orbiting scroll member, and Fs=force applied to the sliding surfaces of the end plates caused by hydraulic pressure.

26. A scroll type fluid machine according to claim 23, wherein the pressure Pb in the first back pressure chamber is determined in accordance with the following relationship:

$$Pb = \left| \frac{1}{2\pi} \int_{\lambda b+2\pi}^{\lambda b} P(\lambda)d\lambda \right|,$$

where:

$\lambda$=a wrapping angle of tbe wraps in radians, $\lambda b, \lambda b+2\pi$=the position of ports in the orbiting scroll member by which the first back pressure passage means communicates with at least one of the working chambers, and P=a pressure in the working chamber.

* * * * *